US007271774B2

(12) United States Patent
Puuri

(10) Patent No.: US 7,271,774 B2
(45) Date of Patent: Sep. 18, 2007

(54) ELECTRONIC WEARABLE DEVICE

(75) Inventor: Heikki Puuri, Vantaa (FI)

(73) Assignee: Suunto Oy, Vantaa (FI)

( * ) Notice: Subject to any disclaimer, the term of this patent is extended or adjusted under 35 U.S.C. 154(b) by 0 days.

(21) Appl. No.: 11/254,693

(22) Filed: Oct. 21, 2005

(65) Prior Publication Data

US 2007/0091004 A1 Apr. 26, 2007

(51) Int. Cl.
*H01Q 1/12* (2006.01)
*H01Q 13/10* (2006.01)

(52) U.S. Cl. ..... 343/718; 343/767

(58) Field of Classification Search ..... 343/718, 343/767, 872, 702
See application file for complete search history.

(56) References Cited

U.S. PATENT DOCUMENTS

| | | | | |
|---|---|---|---|---|
| 4,935,745 | A | 6/1990 | Mori et al. | |
| 5,450,091 | A | 9/1995 | Hama | |
| 5,589,840 | A | 12/1996 | Fujisawa | |
| 5,669,319 | A | 9/1997 | Liang | |
| 5,677,698 | A | 10/1997 | Snowdon | |
| 5,699,319 | A * | 12/1997 | Skrivervik | 368/10 |
| 5,742,256 | A * | 4/1998 | Wakabayashi | 343/718 |
| 5,768,217 | A | 6/1998 | Sonoda et al. | |
| 5,926,144 | A | 7/1999 | Bolanos et al. | |
| 6,130,647 | A | 10/2000 | Zurcher et al. | |
| 6,278,873 | B1 | 8/2001 | Itakura et al. | |
| 6,281,854 | B1 * | 8/2001 | Ohoka et al. | 343/767 |
| 6,282,433 | B1 | 8/2001 | Holshouser | |
| 6,307,520 | B1 | 10/2001 | Liu | |
| 2002/0098807 | A1 | 7/2002 | Saamimo | |
| 2005/0088354 | A1 | 4/2005 | Chang | |

FOREIGN PATENT DOCUMENTS

| | | | |
|---|---|---|---|
| GB | 2 120 048 | A | 11/1983 |
| GB | 2 276 274 | A | 9/1994 |
| JP | 7062940 | A | 3/1995 |
| JP | 10145126 | A | 5/1998 |
| JP | 3181208 | A | 8/1998 |
| JP | 2004242034 | A | 8/2004 |
| WO | WO-98/27609 | A1 | 6/1998 |

* cited by examiner

*Primary Examiner*—Hoang V. Nguyen
(74) *Attorney, Agent, or Firm*—Birch, Stewart, Kolasch & Birch, LLP

(57) ABSTRACT

The invention concerns a wrist-wearable electronic device comprising a slot antenna and a method of manufacturing the slot antenna. Such a device comprises an outer housing defining an assembly zone and a radio unit contained within the assembly zone. According to the invention the outer housing is made at least partly of conductive material and comprises an integral slot antenna formed in the conductive material portion thereof, the antenna being electrically connected to the radio unit. The invention provides a convenient antenna structure for wirelessly communicating wristop computers and the like.

18 Claims, 2 Drawing Sheets

ELECTRONIC WEARABLE DEVICE

BACKGROUND OF THE INVENTION

1. Field of the Invention

The present invention relates to wearable electronic devices. In particular, the invention concerns a wrist-worn device, such as a wristop computer, which has an antenna for communicating wirelessly with other electronic devices. In addition, the invention concerns a method for the manufacture of an antenna for wearable devices.

2. Description of Related Art

Antennas have been assembled into wristop computers for some time for allowing wireless data transfer into and out of the device. However, incorporating an antenna into a wearable device is a challenging task due to size limitations, great amount of electronic components in proximity to each other and due to the closeness of human body.

The patent application US 2002/0098807 discloses a wrist device with an integrated loop antenna. The loop is placed in the same plane with other electronic circuitry of the device such that some of the electronics is located inside the antenna loop, whereby the electronic circuitry act as a ground plane for the antenna.

Loop-type antennas are also disclosed in the U.S. Pat. Nos. 5,768,217, 5,926,144 and 6,278,873.

Slot antennas can be used instead of conventional loop or dipole antennas due to their ability of producing and sensing alternating electromagnetic fields. The field produced by the a slot antenna is very similar in form to that produced by a dipole antenna having equal dimensions, with the exception that the polarization directions of the electric and magnetic fields are interchanged.

A cellular phone having a slot antenna for short-range communication is disclosed in document U.S. Pat. No. 6,282,433. The antenna is used for subscribing directly to a remote computer or to a local area network (LAN).

U.S. Pat. No. 5,699,319 discloses a wrist-watch, which has a built-in dipole antenna or a slot antenna. The antenna is housed between two casings, one of which forms the outer surface of the watch and the other of which houses electronic and mechanical parts of the device. The antenna is formed as a separate element by applying conductive material to an insulator in order to form a suitable antenna pattern.

A major drawback of the wearable devices referred to above is that because the antenna is located deep inside the housing of the device, conductive materials can not be used in the housing of the device due to the resulting attenuation of the signal. Thus, the described structures can not be used in metal-cased or metal-covered devices. In addition, antenna takes a lot of space inside the device and couples easily to the circuitry of the device, whereby the placing of the parts has to be made taking into account the proximity of the antenna.

SUMMARY OF THE INVENTION

It is an aim of the present invention to eliminate some of the problems of the prior art and to provide a wearable device having a novel antenna construction.

In particular, in is an aim of the invention to provide a device which comprises an antenna construction which is suited for devices having electrically conductive casings, such as metallic or metal-containing covers.

Thus, the invention is based on the idea of integrating a slot antenna into the cover (outer housing) of the device, the slot antenna being formed in an electrically conductive portion contained in the cover. Such a device generally comprises a radio unit within an assembly zone defined by the cover, the radio unit being electrically connected to the slot antenna.

The slot can be formed in a conductive coating applied on the device cover or in the form of an opening in a cover made of conductive material. A particularly advantageous solution is achieved if the slot antenna is at least partly located on the outer surface of the cover.

More specifically, the invention is characterized by what is stated in the characterizing part of claim 1.

The method according to the invention is mainly characterized in the characterizing parts of claims 12 and 14.

Use of slot antennas in wearable devices is characterized in claim 16.

Considerable advantages are obtained by means of the invention. In particular, the invention allows the use of partly or fully conductive cover to be used in a wirelessly communicating wearable device without significant attenuation of signal due to the cover. In addition, a slot antenna placed on the outer cover is easy to manufacture and is relatively weakly coupled to other electronic and conductive parts of the device due to its peripheral location. The cover acts as a conductive cage causing the antenna to radiate primarily to the exterior of the device.

The slot can be formed to a metal cover in the manufacturing stage of the cover. Typically, such covers are fabricated from a single block of metal, whereby forming of the slot would be only a minor sub-step in that stage. Moreover, in the assembling stage of the device, no additional steps would be needed because of the antenna. Thus, such a solution does necessitate any complex mechanical or electrical arrangements within the device, whereby the number of components and further the size of the device can be kept small. Efficient utilization of the housing of the device as the radiating element gives also relatively free hands for placing of other components within the housing.

Placing the antenna on the outer housing of the device enables making the effective dimension of the antenna larger, and therefore using longer wavelengths, than if the antenna is placed in the interior parts of the device. In addition, directioning of radiation can be adjusted by the three-dimensional structure of the conductive portions of the cover.

The term "slot", in the context of this document, means an elongated recess, in particular an elongated opening, in the conductive material (or materials) contained in the cover, the recess being capable of transmitting and/or receiving electromagnetic radiation at a desired frequency and bandwidth. The slot may be open or filled with some dielectric material, such as polymer.

In the preceding and following text, the terms "cover" and "outer housing" are used interchangeably and refer to parts or entities that are provided for protecting or mounting the internal parts of the device (in the assembly zone), such as electronic circuitry, for mounting user interface members, such as buttons and display, to the device, for forming the appearance of the device, or for allowing attachment of watchband, for example. Typically, these parts or entities are at least partly visible from the outside of the device. Thus, the cover or housing can be formed of a single part or a plurality of parts. The assembly zone is preferably in the form of a cavity or recess, within which at least part of the electronic circuitry of the device is engineerable.

Next, the invention will be examined more closely with the aid of a detailed description and with reference to the attached drawings.

DETAILED DESCRIPTION OF THE INVENTION

The devices and antennas according to embodiments disclosed in this document below can be used for communicating, for example, with a peripheral device, such as a heart rate monitor belt (or other separate vital function-sensitive transmitter), speed and/or distance measuring foot or bike pod (separate motion-sensitive transmitter), a GPS receiver placed in a place in the vicinity of the device and transmitting location data to the wrist device (separate location-sensitive transmitter), or an environment-sensor. In addition, the device can communicate with another compatible wristop device, with a remote computing unit, such as a computer having a suitable adapter, in a wireless network, such as local or wide area network (LAN/WAN), in Bluetooth-applications or, for example, with a sports timing or performance monitoring system of a special kind. The antenna can also be used for receiving Global Positioning System (GPS) signals or in a mobile telephone network. Typically, the device is capable of communication at UHF or microwave ranges. In particular, the described antenna construction allows good-quality communication in frequencies of about 2.4 GHz, which are used, for example, in Bluetooth-compatible communication.

The slot antenna can serve as a transmitting antenna, receiving antenna or transceiver antenna, depending on the intended use of the device. Thus, the radio unit can comprise electrical transmitting (excitation) means, receiving means, or both. There may be provided Bluetooth-compatible signal and/or data processing units connected to the radio unit or contained in the radio unit.

Figure 1:
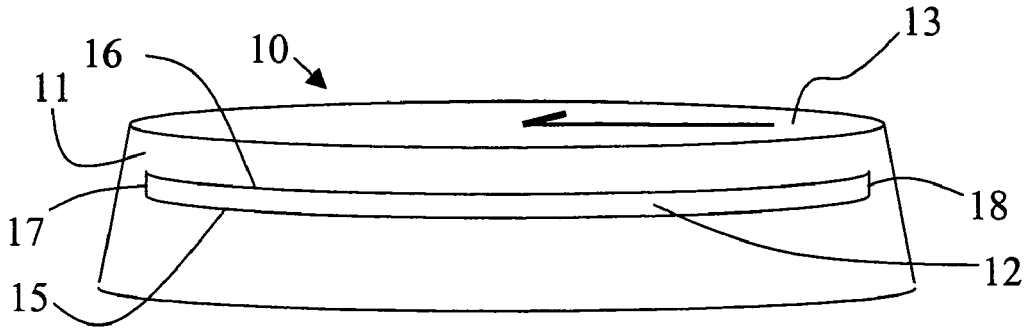
FIG. 1 depicts a schematic perspective view of a first preferred embodiment of the device in accordance with the invention, wherein the slot is established on the brim of a fully conductive cover piece.
Figure 2:
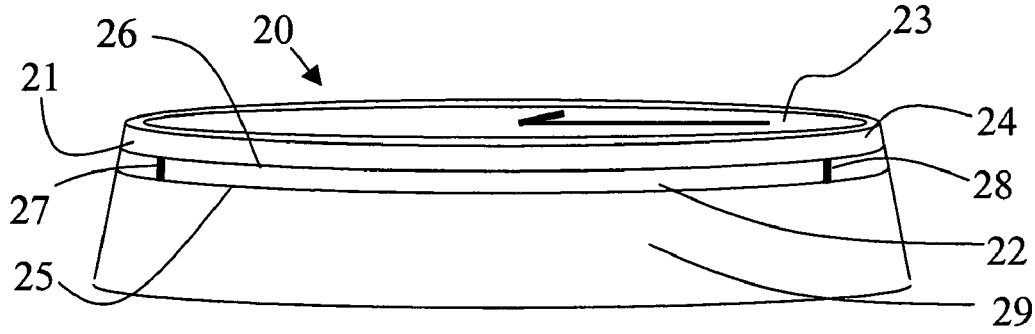
FIG. 2 shows a schematic perspective view of a second preferred embodiment of the device in accordance with the invention, wherein the slot is formed between a main body part and a conductive ring attached on top of the main body part.
Figure 3:
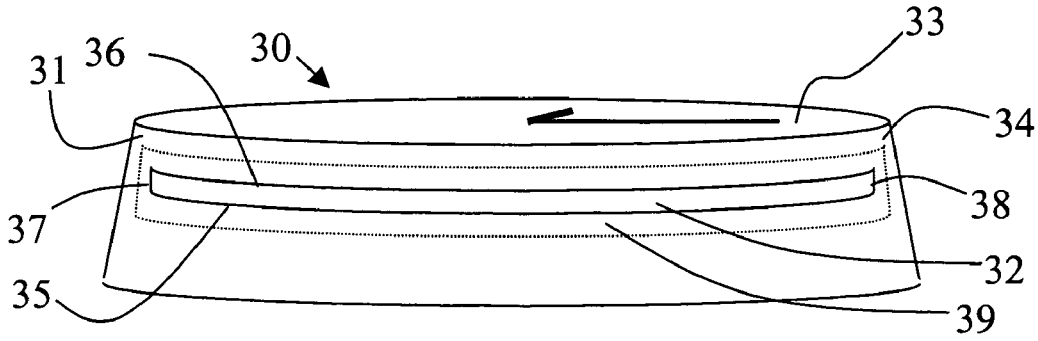
FIG. 3 illustrates a schematic perspective view of a third preferred embodiment of the device in accordance with the invention, wherein the slot is formed on a conductive foil or coating contained on the cover.

With reference to FIGS. 1-3, the device preferably comprises a main unit 10, 20, 30 and a watchband. The main unit includes the cover having the embedded slot antenna and electronic components housed in the cover. The cover typically comprises a torus-like fringe zone, wherein the slot antenna is formed. Thus, the antenna typically has a curved, in particular an arc-like shape. A display or dial 13, 23, 33 is typically located in the main unit, typically within a recess or opening on the top side of the main unit.

Figure 4:
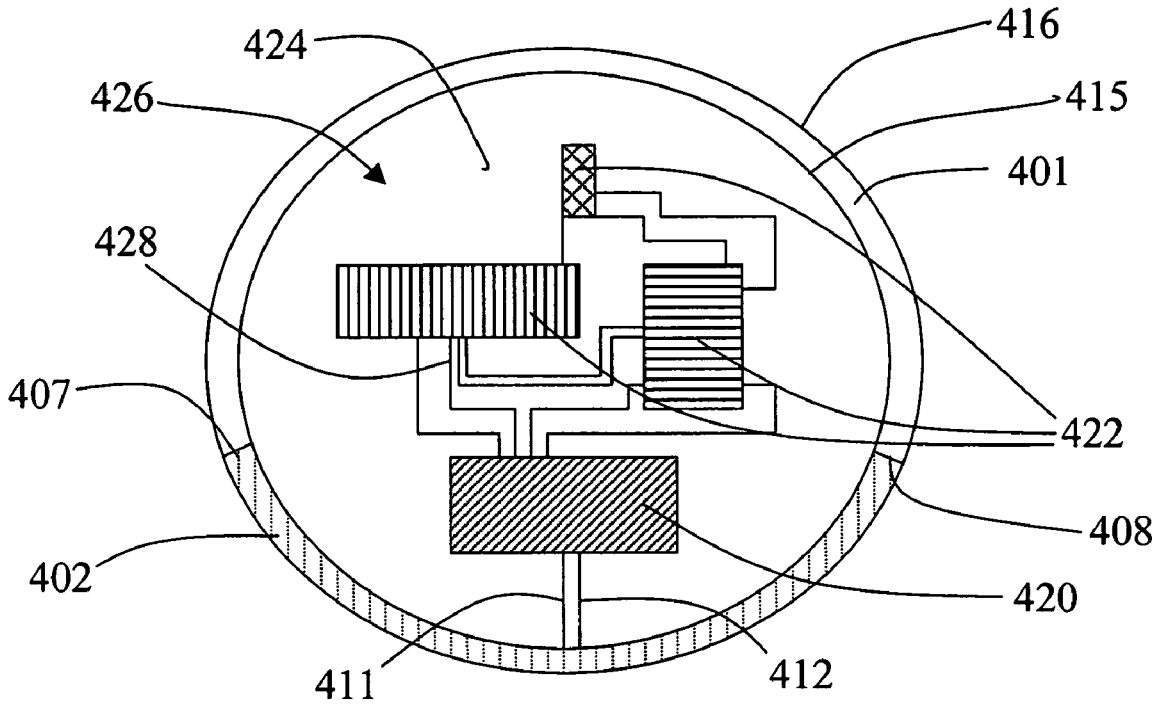
FIG. 4 shows a schematic cross-sectional top view of the housing and assembly zone of the device in accordance with the invention.

With reference to FIG. 4, the cover 401 typically comprises also a bottom plate 424, which seals the structure from the opposite side of the dial. The engine, that is, electrical components 422, internal wiring 428 and possibly also mechanical parts (not shown) of the device are typically located within the cavity 426 defined by the inner surface 415 of the cover 401, although some or all of the electronic parts may also be embedded into the cover material (between the inner surface 415 and outer surface 416 thereof).

The slot 402 is preferably arranged onto the brim or fringe of the cover 401 such that it, in its longitudinal direction, follows the shape of the periphery 416 of the cover essentially in lateral plane (i.e., in a plane essentially parallel to the plane of the dial of the device). However, the slot 412 may also be shaped such that it has a significant dimension also perpendicular to that plane. The slot 412 can also be formed on the dial side of the device, whereby the dial section is to be understood as a part of the outer housing.

In general, in its narrower dimension, the slot is defined by a first conductive boundary 15, 25, 35 and a second conductive boundary 16, 26, 36. The first boundary 15, 25, 35 opposes the second boundary 16, 26, 36 such that a slot 12, 22, 32 (gap or recess) is formed between the boundaries. The slot is preferably of constant width. The boundaries are connected by conductive end portions 17, 18; 27, 28; 37, 38, which define the extremities of the slot. The length of the slot is defined by the mutual distance of the extremities, when travelled along the slot. In the case of a recess-type slot, the boundaries are connected also by a bottom of the slot. The bottom is preferably formed of dielectric material.

The length of the slot is preferably at least, typically essentially exactly, $\lambda/2$, where $\lambda$ is the wavelength of the electromagnetic radiation. The width of the slot has to be significantly less that the wavelength. Thus, the wristop slot antenna is most suitable for UHF and microwave ranges.

Due to the typically curved form of the slot, the length of the slot and the linear distance between the end portions of the slot are not equal. That is, the phase difference of the electrical signal travelling along the slot and the phase difference of the electromagnetic field between the end portions differ from each other, whereby the electromagnetic field does not feed the antenna optimally (or, when transmitting, the antenna does not radiate optimally). According to an advantageous embodiment, the slot is such dimensioned, that phase difference of the electromagnetic field between the end portions is less than 50%, in particular less than 40%, most preferably less than 25% smaller than the phase difference of the electric signal at the slot.

According to a first embodiment shown in FIG. 1, the cover 11 is essentially entirely made of conductive material, whereby a slot 12 is fabricated directly to the cover. The slot 12 can be an opening having a length relative to the desired wavelength, on the brim of the cover 11. Longitudinally oriented boundaries of the slot 12 are denoted with reference numerals 15 and 16 and transverse boundaries with reference numerals 17 and 18. The slot 12 can be formed simply by forming a cut to the cover material, for example, by sawing, drilling or chamfering.

According to a second embodiment shown in FIG. 2, the cover 21 comprises at least two separate parts 24, 29 (slot-forming members), which are attached together in order to form a slot 22 between the parts. A particularly advantageous embodiment is achieved by providing a first cover part 29 forming the first boundary 25 of the slot 22, and optionally also the extremities 27, 28 of the slot. The slot 22 is completed by providing the second boundary 26 in the form of second cover part 24, such as a separate conductive plate, ring, rod or equivalent onto the first cover part 29. The second cover part can be a special-purpose element or a part of the dial portion of the device, for example, a bezel or another member which is used for mounting a glass, a window or a display to the device. The electrical contact of the plate or ring with the first cover part has to be assured by sufficient clamping of the parts and/or by using a proper contacting substance. The slot-forming members 29, 24 can also be fastened to each other with screws 27, 28, whereby the distance of the screws determines the length of the slot, i.e., form the extremities of the slot. More generally, there may also be provided separate contact members 27, 28 between the first and the second cover parts 29, 24, the contact members determining the length of the slot. This embodiment provides a robust construction, where the conventional parts of the device can be used for forming the slot 22 in a novel way.

According to a third embodiment illustrated in FIG. 3, the cover 31 is partly made of first material 34 and partly of second material 39 (or a plurality of first and second materials). The slot is formed in the second material portion 39 of the cover, the second material portion being electrically conductive. The second material can be in the form of a plate, film or foil, which is preferably attached on the outer surface of the cover. In FIG. 3, the slot 32 is formed on a narrow foil 39, which is applied on the outer surface of the first material portion 34. The first material portion can also be essentially entirely coated with second material, into which the slot 32 is formed. This embodiment allows a slot antenna being formed also on devices which have a mainly dielectric housing (dielectric first material portion 34) made of plastic, for example. The second material portion of the cover may be brought onto the first material, for example, by conventional metallization techniques, laminating, glueing, vaporizing, brushing, spilling, dip application etc. The slot can be formed, in case not already formed in the second material application phase, by removal of conductive material, for example, by mechanical fabrication or etching. According to one embodiment, the conductive material, the etching compound, or both, are brought onto the cover by printing.

The principal embodiments described above and illustrated in the drawings can also be freely combined to create various other housings and slot structures.

According to a further embodiment, the slot, i.e., the elongated recess, in particular opening, is filled with dielectric material for making the cover water- and dust-proof. This is of specific importance, if the slot is provided in the form of a complete opening in the housing.

The coverage and directivity of the electromagnetic field can be affected by the geometric properties of the slot and the cover. The general direction of radiation field is determined by the orientation of the slot, the most effective direction (best coverage area) being typically normal to the plane (surface) defined by the outer boundaries of the slot. Conductive matter in the vicinity of the slot enhances the field outside the cover, at the same time reducing the coupling of the interiors of the device to the field.

We have found that the shape of the cover of the device can be efficiently used in achieving a field coverage of desired kind. In some applications, it is advantageous to tilt the slot such that the best coverage area is formed conically upwards from the lateral plane, whereby also the front side of the device becomes covered better and the coupling of the antenna to the user of the device is weakened. In such solutions, the cover of the device can be shaped such that it is sloping towards to dial. Thus, the slot settles to the cover automatically in the correct inclined angle. This embodiment can be conveniently combined with all the cover and slot constructions described above.

According to a preferred embodiment, in the vicinity of the first and second boundaries, there are located first and second terminals, respectively. The first and second terminals are used for electrical excitation of the antenna or for readout of the antenna signal. The terminals are electrically connected to the conductive area of the cover in order to achieve the desired mode of oscillation of the antenna. In FIG. 4, the electrical connection between the radio unit 420 and the antenna 402 is illustrated by wirings 411 and 412. Typically, the terminals are located symmetrically on both sides of the slot 402 in the vicinity of its boundaries essentially in the middle of its length, as shown in FIG. 4.

The first and second terminals of the antenna 402 are typically connected to a radio unit 420 located inside the device by a suitable connection member or members 411, 412. There may be provided, for example, a coaxial or twisted-pair transmission line between the radio 420 unit and the terminals. The transmission line can have balancing properties or a separate balancing transformer (balun) may be used, when needed. In some embodiments, the radio unit 420 may be located in such a position relative to the terminals of the antenna 402 that it can be directly connected to the terminals, that is, without a separate transmission line. There may also be additional electronics, such as a (pre) amplifier, connected to the antenna 402 and/or the radio unit 420. There may be arranged a electrical ground plane in the form of conductive plate in the vicinity of the slot inside the cover.

Typically the wearable device also comprises a timer unit, microprocessor and a memory unit contained inside the housing. There may also be provided, inside or outside the housing, a sensor or a plurality of sensors, such as environmental sensors, acceleration sensors, alignment sensors, proximity sensors and body sensors functionally connected to the device. The sensor(s) and the computing means listed above may be functionally connected to each other and finally to the slot antenna for transmitting data provided by the sensor. The housing of the device can perform the functions of protecting the electronics inside the housing from undesired electric and magnetic fields and at the same time function as an effective antenna for data transmission at a selected frequency band.

The wristop device according to the embodiments described above has several application areas. As appreciated by a person skilled in the art, by establishing a data link with, for example, a computer or another such device, data of any kind can be transferred between the instruments.

The embodiments described above can be used in sports-related applications, where durable, preferably metal-covered wristop computers are becoming more common. The device can be used both during exercises and before and after them for data transfer and analysis. Local area networking, Bluetooth-type and special-purpose applications are easy to find in a number or sports. For example, in running, cycling, walking and racing a data link can be formed to and/or from wristop device for timing purposes and for keeping all competitors aware of the status of a competition, etc. In orienteering, the device can form part of the competition-tracking system. In point-count sports, such as golf, tennis, and the device can be used either for allowing the points fed by the user to be transferred to other players or for allowing the latest competition data to be transferred to a player. In all sports, the device can be used as a lightweight communication unit for communication between a sportsman and his coach during an exercise and for transferring performance-related data to external data processing means.

As is apparent to a person skilled in the art, there may also be embedded several slot antennas in a single device, probably of different dimensions or orientations and for different purposes.

The invention claimed is:

1. A wrist-wearable electronic device, comprising:

an outer housing defining an assembly zone, the outer housing being made at least partly of conductive material, a radio unit contained within the assembly zone, and an integral slot antenna formed in the conductive material portion of the outer housing, the antenna being electrically connected to said radio unit, and a receiving device which receives through the slot antenna data provided by a peripheral device, the peripheral device being one of a vital function-sensitive transmitter, a motion-sensitive transmitter, a location-sensitive transmitter, and an environment sensor.

2. The wearable device according to claim 1, wherein the slot antenna is formed on the outer surface of the housing.

3. The wearable device according to claim 1 or 2, wherein the slot antenna is in the form of an elongated recess in the housing, the width of the recess being limited by a first conductive boundary and a second conductive boundary opposing the first boundary, and the length of the recess being limited by conductive end portions.

4. The wearable device according to claim 1, wherein the housing is essentially entirely made of conductive material, the slot antenna being provided in the form of an elongated opening in the housing.

5. The wearable device according to claim 1, wherein the housing comprises dielectric first material portion and conductive second material applied on surface thereof, the slot antenna being formed on the second material portion.

6. The wearable device according to claim 5, wherein the conductive second material is located on the outer surface of the first material portion.

7. The wearable device according to claim 1, wherein the housing comprises at least two parts, at least some portions of said parts forming the longitudinal boundaries of the slot antenna.

8. The wearable device according to claim 7, wherein one of said parts forms one longitudinal boundary of the slot antenna and another of said parts frames an opposing longitudinal boundary of the slot antenna and said parts are attached together with conductive mounting means, which form end portions of the slot antenna.

9. The wearable device according to claim 7 or 8, wherein one of said parts is a holder designed to hold a protective glass or plastic of the face of the device.

10. The wearable device according to claim 1, wherein the slot is filled with dielectric material, such as polymer, for sealing the slot.

11. The wearable device according to claim 1, which further comprises a timer unit, microprocessor, memory unit and at least one sensor functionally connected to each other and the slot antenna for transmitting data provided by the sensor.

12. The wearable electronic device according to claim 1, wherein the means for receiving through the slot antenna data from the peripheral device are adapted to receive data from a heart rate monitor or a speed- and/or distance-measuring device.

13. A method for forming a slot antenna for a wrist-wearable device, the method comprising:

providing a device housing capable of accommodating a radio unit, the housing being at least partly made of conductive material, and removing conductive material from said housing in order to form an elongated recess having a first conductive boundary and a second conductive boundary opposing the first boundary and two conductive end portions which connect the first and second boundaries on each end of the recess.

14. The method according to claim 13, wherein said removal of material is carried out by mechanical fabrication, such as sawing or milling, or by chemical means, such as etching.

15. A wearable electronic device, comprising:

an outer housing defining an assembly zone, the outer housing being made at least partly of conductive material, a radio unit contained within the assembly zone, and an integral slot antenna formed in the conductive material portion of the outer housing, the antenna being electrically connected to said radio unit, a timer unit, a microprocessor, a memory unit and at least one sensor functionally connected to each other and the slot antenna for transmitting data provided by the sensor.

16. A wearable electronic device, comprising:

an outer housing defining an assembly zone, the outer housing being made at least partly of conductive material, a radio unit contained within the assembly zone, an integral slot antenna formed in the conductive material portion of the outer housing, the antenna being electrically connected to said radio unit, and a transmitting device which transmits through the slot antenna data provided by one of a vital function-sensitive sensor, a motion-sensitive sensor, a location-sensitive sensor or an environment sensor.

17. A wearable electronic device, comprising:

an outer housing defining an assembly zone, the outer housing being made at least partly of conductive material, a radio unit contained within the assembly zone, and an integral slot antenna formed in the conductive material portion of the outer housing, the antenna being electrically connected to said radio unit, wherein the housing comprises at least two parts, at least some portions of said parts forming the longitudinal boundaries of the slot antenna, and one of said slot-forming parts being a member used for mounting a protective glass or plastic or a display to the device.

18. The wearable electronic device according to claim 17, wherein the slot-forming parts are a separate conductive element formed as one of a bezel, plate, ring, and rod.

* * * * *